United States Patent [19]

Flack et al.

[11] 4,262,507

[45] Apr. 21, 1981

[54] CYLINDER LOCK WITH HOTEL FUNCTION

[75] Inventors: Max L. Flack, Noblesville; William G. Roos, Indianapolis, both of Ind.

[73] Assignee: Best Lock Corporation, Indianapolis, Ind.

[21] Appl. No.: 972,977

[22] Filed: Dec. 26, 1978

[51] Int. Cl.[2] ..... E05B 41/00

[52] U.S. Cl. ..... 70/432

[58] Field of Search ..... 70/149, 224, 370, 432, 70/451, 461, 462; 292/336.3, 347, 352

[56] References Cited

U.S. PATENT DOCUMENTS

| | | | |
|---|---|---|---|
| 2,983,134 | 5/1961 | Russell | 70/432 |
| 3,368,375 | 2/1968 | Russell | 70/149 |
| 3,955,387 | 5/1976 | Best | 70/224 |

OTHER PUBLICATIONS

Best Universal Lock Co., Inc.—Challenger 900 Series (Regent), Hotel Function Adaptation, 7-1967-4 sheets of drawings.

*Primary Examiner*—Robert L. Wolfe

*Attorney, Agent, or Firm*—Jenkins, Coffey, Hyland, Badger & Conard

[57] ABSTRACT

Apparatus for providing a "hotel function" in a cylinder lock having a key-removable locking core in its outside knob. Actuation of a push button in the inside knob causes the core to be disabled from retracting the bolt and projects an indicator from the face of the outside knob. The key plug of the core is connected to rotate a throw member which is axially movable between an inward operative position and an outward disabling position. The throw member is connected to the roll-back cam by a flat blade slidable in a cross slot in the roll-back cam sleeve. In the operative position of the throw member, a full width section of the blade lies in the cross slot to clutch the blade to the roll-back cam, while in the disabling position, a narrowed section of the blade lies in the cross slot and is rotatable therein so as to declutch the blade from the roll-back cam. The throw member is biased to operative position and, when thrust to disabling position by the push button, is latched by a catch piece carried by the bolt retractor. The indicator is connected by a collar to the throw member so as to be moved axially to its projected position when the push button is actuated.

9 Claims, 5 Drawing Figures

CYLINDER LOCK WITH HOTEL FUNCTION

This invention relates to cylinder locks for doors, and especially to a cylinder lock having the so-called "hotel function" by which a key-actuated tumbler lock in the outside knob of a hotel room door is disabled by actuation of a push button or the like in the inside knob so that the occupant of the room will not be disturbed by service personnel. More particularly, the invention relates to such a cylinder lock having a key-removable lock core in its outside knob.

The invention is particularly applicable to a cylinder lock of the type shown in U.S. Pat. No. 3,955,387 of May 11, 1976. Such a lock has an outside knob supported on a lock sleeve or spindle mounted in the outside hub of a lock chassis and having a key-removable core in the face of the outside knob, preferably a figure-8 shaped core as shown for example in U.S. Pat. No. 3,603,123. Such cylinder lock also has an inside knob supported on a lock sleeve or spindle and rotatably mounted in the inside hub of the lock chassis. The center of the inside knob has an opening for the reception of turn or push button for controlling the function of the outside knob and core.

In accordance with the present invention, the outside knob and its knob sleeve are permanently locked against rotation relative to the fixed hub of the chassis, so that the lock can be operated from the outside only by key actuation of the lock core in the face of the knob. Such lock core is normally connected to a key-actuated roll-back sleeve having a roll-back cam at its inner end to engage and actuate the bolt retractor when such sleeve is rotated by key actuation of the key plug of the core. The connecting means between the key plug and the roll-back sleeve includes an axially movable throw element which in its normal position clutches the key plug to the roll-back sleeve, so that key operation of the core will retract the bolt. The throw element also has a disabling position in which it declutches the key plug from the roll-back sleeve, so that key operation of the core will be ineffective to retract the bolt. A control element such as a push button in the inner knob is connected to move the throw element from its normal position to its disabling position, where it is held by a latch until bolt retraction by the inside knob releases the latch and allows the throw element to move to its normal operating position.

Preferably, the axially movable throw element is connected to move an indicator blade forward at the face of the outside knob to an indicating position when the throw element is moved to its declutched or disabling position.

The accompanying drawings illustrate the invention and show a preferred embodiment. In such drawings.

Figure 1:
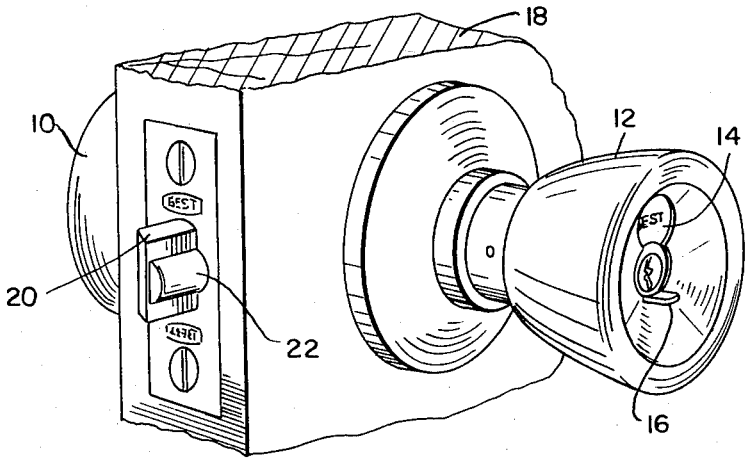
FIG. 1 is a perspective view of a cylinder lock embodying the invention, mounted in a door, and with the indicator blade projected to indicate that the outside key-actuated mechanism has been disabled.

The cylinder lock shown in the drawings comprises an inside knob 10 and an outside knob 12 having a key-removable core 14 of figure-8 cross section mounted in its front face. See FIGS. 1 and 5. An indicator blade 16 projects through such front face immediately below the core 14. The knobs 10 and 12 are mounted at opposite faces of a door 18 and are connected to control a latch bolt 20 mounted in the edge of the door. Preferably, the latch bolt 20 is a deadlocking bolt with an auxiliary bolt 22 mounted adjacent its flat face and operative to cause the latch bolt to be deadlocked when that auxiliary bolt is held back by a strike. The bolt mechanism may be as shown in U.S. Pat. No. 3,876,236 of Mar. 8, 1975.

The cylinder lock mechanism shown in FIGS. 2–5 is substantially identical with that shown in U.S. Pat. No. 3,955,387, except for modifications adapted to provide that cylindrical lock with a so-called hotel function. The inside knob 10 is mounted on a knob sleeve 24 which is rotatable in the inside hub 26 fixed to a side plate 28 of the lock chassis. The knob sleeve 24 has a roll-back cam 30 at its inner end in position to engage one side of a retractor 32. The outside end of the knob is closed by a face plate 34 having a central opening aligned with the knob sleeve 24 and adapted to receive a push button 36 connected to a thrust rod 38 which extends to a position for operating the hotel function mechanism described below. The push button and rod 38 are biased to normal OUT position by a spring 37.

Figures 2, 4:
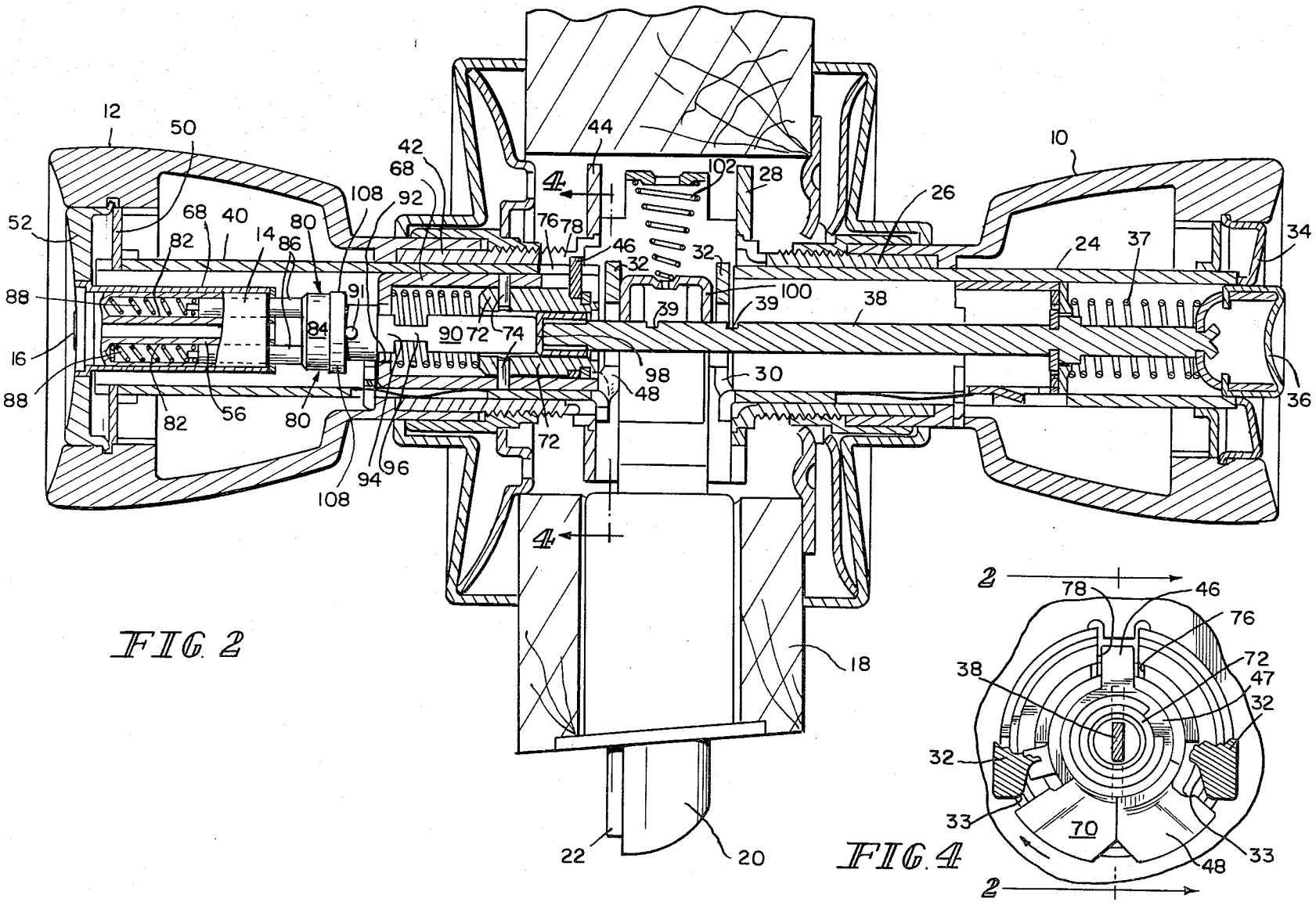
FIG. 2 is a horizontal axial section of the cylinder lock shown in FIG. 1, with the push button shown in its normal OUT position so that the lock core in the outside knob is connected for normal operation of the roll-back cam.
FIG. 4 is a transverse section taken on the line 4—4 of FIG. 2, with fragmental cam portions of a bolt retractor shown in relation to the roll-back cams.

The outside knob 12 is mounted on a knob sleeve 40 which is supported in the outside hub 42 of the outside side plate 44 of the lock chassis. In the standard lock, as shown in Pat. No. 3,955,387, the knob sleeve 40 is normally rotatable in the hub 42 but may be locked to that hub when it is desired to prevent the lock from being operated by the handle and limit operation to key actuation of the core. For purposes of the present invention, the knob sleeve 40 is permanently locked against rotation in the hub 42, so that the lock is operable from the outside only by key actuation of the core 14. Such locking is by means of a locking lug 46 which extends through aligned notches 76 and 78 in the sleeve 40 and the hub 42. The knob sleeve 40 may be of standard construction and provided with a roll-back cam 48 at its inner end as shown in FIGS. 2 and 4, nevertheless, the sleeve will be inoperative to actuate the retractor 32 because the spindle is locked against rotation.

Figure 5:
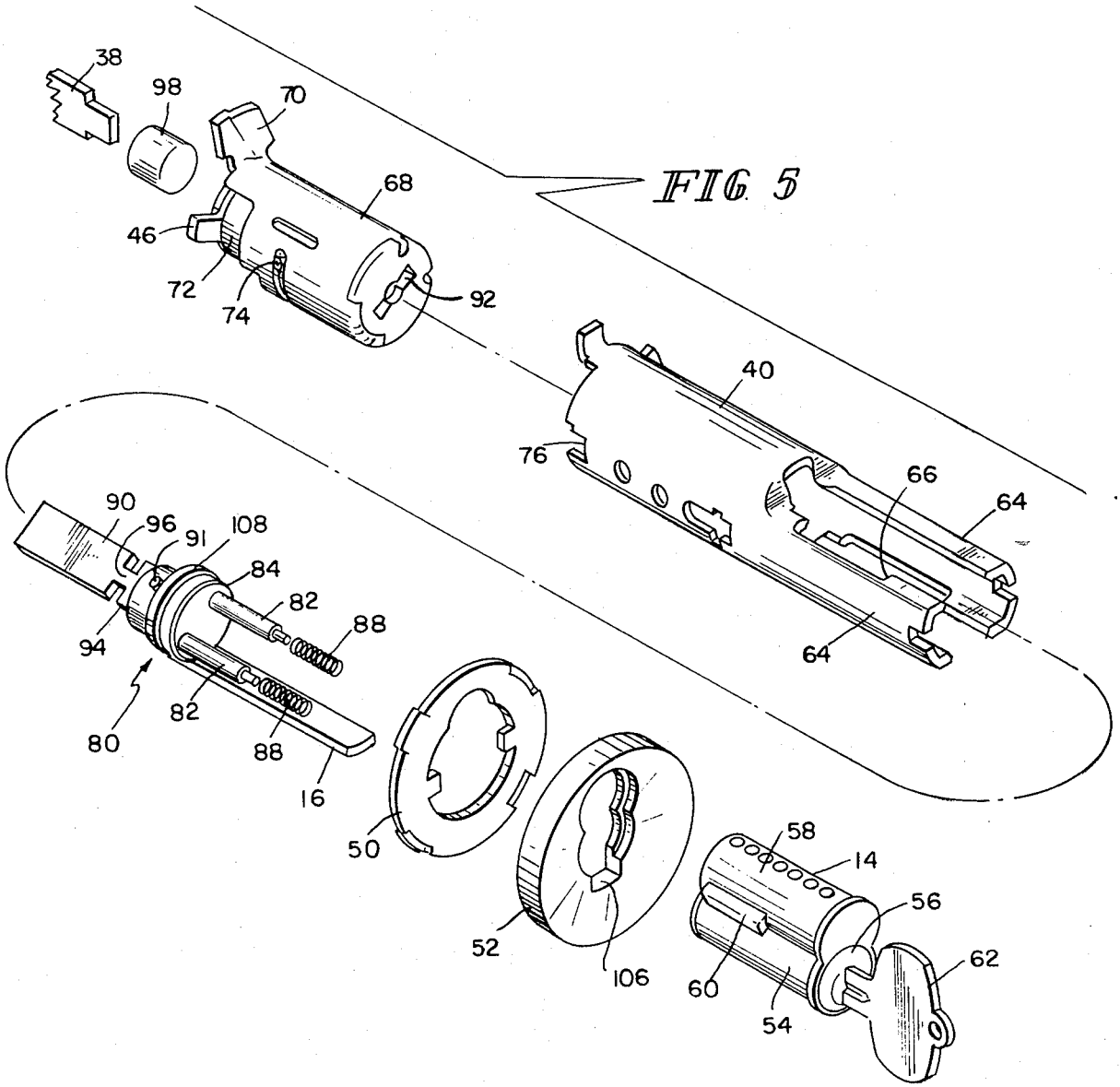
FIG. 5 is an exploded view of the outside knob sleeve or spindle and its associated operating parts.

The outer end of the knob 12 is supported on the outer end of the knob sleeve 40 by a ring 50, and the outer end of the knob is closed by a face plate 52. Both such ring and face plate have openings for the reception of the key-removable lock core 14. As shown in FIG. 5, the core 14 is of figure-8 cross section, with a lower cylindrical lobe 54 containing a key plug 56, and with an upper lobe 58 containing a row of pin tumblers. The core is adapted to be locked in place by a retainer lug 60 which normally projects from the side of the core, between the two lobes, but which may be retracted by a special control key 62 so as to permit the core to be inserted in a suitably shaped core chamber. The outer end of the knob sleeve 40 is formed with a pair of opposed channel sections 64 having inner edges adapted to embrace the lower lobe 54 of the core and define a core chamber. One leg of each channel is formed with a shoulder 66, behind which the retaining lug 60 of the core may be projected when the core is in place so as to retain the core in the support formed by the two channels 64.

The inner end of the knob sleeve slidably receives a key-actuated roll-back sleeve 68 which carries a roll-back cam 70 at its inner end, in position to move against a cam face 33 on the retractor. In FIG. 2, such cam 70 lies in the plane of the roll-back cam 48, but in front of the plane of FIG. 2 as indicated in FIG. 4. A locking lug bushing 72 is mounted inside the roll-back sleeve 68, and is desirably pinned thereto by a pair of pins 74. The inner end of the locking lug bushing supports a collar 47 integral with the locking lug 46. As explained above, the locking lug extends through a slot 76 in the inner end of the knob sleeve 40 and into a slot 78 in the inner end of the hub 42, and thereby locks the knob sleeve 40 against rotation relative to that hub 42. The collar of the locking lug is loose on the locking lug bushing so that such bushing and its connected roll-back sleeve 68 can be rotated by key actuation to cause the roll-back cam 70 to move the retractor 32 to retract the bolt 20.

Figure 3:
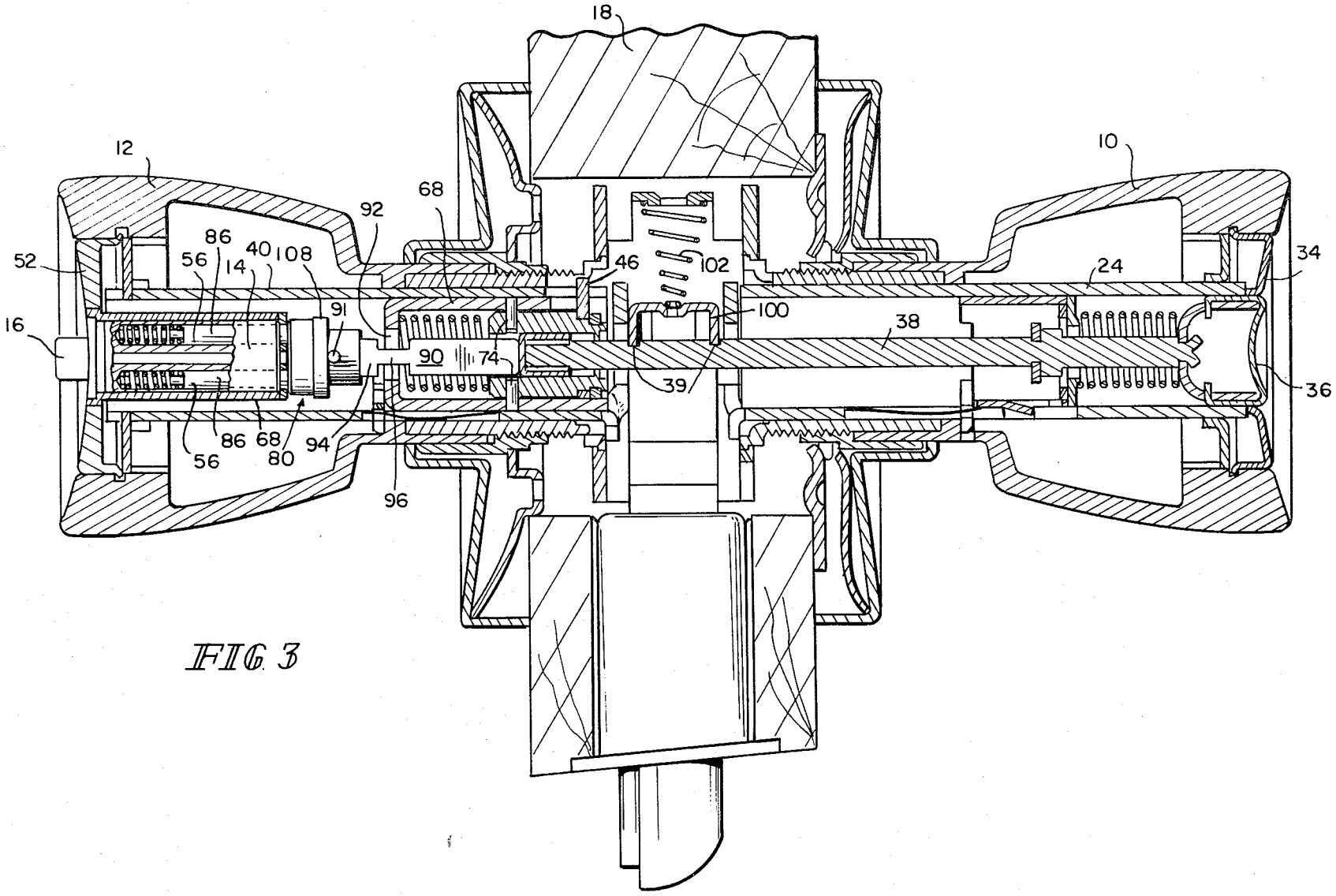
FIG. 3 is a view like FIG. 2, but with the push button shown in its IN position and with the hotel function parts in their disabling positions.

The roll-back sleeve 68 is connected to the key plug 56 of the lock core 14 by a throw plug assembly 80 which is axially movable between a normal operative or engaged position and a disabling or disengaged position. In its normal position shown in FIG. 2, it is engaged with the roll-back sleeve 68 to transmit rotary motion from the key plug to that roll-back sleeve, while in its disabling position it disengages the throw plug from operative connection with the roll-back sleeve 68. In a standard lock core 14, the key plug 56 has two diametrically spaced holes 82 extending axially inward from its rear end. The throw plug assembly 80 includes a central body 84 which carries two forwardly extending throw pins 86 which are slidably received in those holes 82 in the key plug so as to transmit rotary motion from the key plug to the throw assembly. The throw plug assembly is desirably biased to its normal position, and the bias is conveniently provided by a pair of springs 88 mounted in the inner ends of the holes 82 and bearing against the inner ends of the pins 86. Desirably, the springs 88 are made to have a tight fit on center studs on the ends of the throw pins 86, and are expanded at their inner ends to have a tight fit in the holes 82, so that the springs tend to be retained in those holes and to retain the throw pins 86 to themselves and in the holes. The opposite end of the throw assembly body 84 carries a flat blade 90 which is fixed in a cross slot in the body 84 by a pin 91 and which projects through a diametric slot 92 in the rear end wall of the roll-back sleeve 68. The blade 90 has a full-width section 94 adjacent the end of the body 84, which full width section is normally engaged in the cross slot 92 to transmit rotary motion of the throw plug assembly to the roll-back sleeve 68. Beyond such full width section, the blade 90 includes a narrow section 96 which is rotatable in the slot 92, so that when it is moved into the slot 92 it will declutch or disengage the throw plug assembly from the roll-back sleeve 68 and prevent rotary motion of the throw plug assembly from being transmitted to that roll-back sleeve. The end of the blade 90 extends into the bore of the locking lug bushing 72, in abutting relation with a cup 98 slidably mounted in that bore. The cup receives the inner end of the thrust rod 38 connected to the push button 36 in the inside knob 10, and the relationship is such that when the button 36 is in its normal OUT position as shown in FIG. 2, the full width section 94 of the blade 90 is engaged in the notch 92 of the roll-back sleeve, while when the push button 36 is pushed to its IN position as shown in FIG. 3, the whole throw plug assembly 80 is moved axially to the left from its normal position (FIG. 2) to its disabling position (FIG. 3) so as to bring the narrow section 96 of the blade 90 into the cross slot 92 of the roll-back sleeve 68, and thereby to disengaged the throw plug assembly from driving relation with the roll-back sleeve 68.

To retain the throw plug assembly in this disengaged position, the thrust rod 38 has two notches 39 which, when the push button is pushed IN, move into position to be engaged by the edges of a catch member 100 mounted in the retractor assembly 32 and biased toward engaged position by a spring 102, in accordance with known practice. When the retractor 32 moves rearward to retract the bolt 20, as by manual operation of the inside handle 10, the catch member is withdrawn from the notches 39, and this allows the thrust rod 38 and the push button 36 to return to their normal position under the influence of the biasing spring 37, and allows the throw plug assembly 84 to return to its normal position shown in FIG. 2 under the influence of its biasing springs 88.

When it is desired that a visual indication be given at the face of the outside knob that the lock core 14 is disabled from retracting the bolt 20, an indicator blade 16 is mounted for sliding movement adjacent the bottom of the core 14 and through a notch 106 in the face plate 52. See FIGS. 1 and 5. The indicator blade 16 is connected at its rear end to a collar 108 which is rotatably received on the body 84 of the throw plug assembly, between a shoulder on that body and the blade-retaining pin 91. The loose engagement of the collar 108 on the body 84 permits the throw plug assembly to be rotated in the collar 108, as needed to transmit rotary motion from the key plug 56 to the roll-back sleeve 68.

Operation of the lock is as follows. With the hotel function parts in their normal position, as shown in FIG. 2, the push button 36 will be in its normal OUT position, the edges of the catch member 100 will rest against the side of the thrust rod 38, and the throw plug assembly 84 will be in its normal engaged position in which the full width section 94 of its blade 90 is engaged in the notch 92 of the roll-back sleeve 68. The bolt 20 can be retracted by manual turning of the inside knob 10, but not by the outside knob 12 which is locked against rotation by engagement of the locking lug 46 in the aligned notches 76 and 78 in the knob sleeve 40 and the stationary hub 42. Retraction of the bolt from the outside will be possible only by key actuation of the core 14. By insertion of an appropriate operating key, the key plug 56 can be turned, and its rotation will be transmitted by the throw pins 86 to the throw plug assembly 80, and the throw plug assembly rotation will be transmitted by the full width section 94 of the blade 90 to the roll-back sleeve 68. This will drive the roll-back cam 70 clockwise in FIG. 4 against a cam face 33 on the retractor 32 so as to move that retractor in a direction to retract the bolt 20. While if standard lock parts are used, there will be an opposite roll-back cam 48 on the outside knob sleeve 40, this will be inoperative since the outside knob sleeve 40 will be locked against rotation by the locking lug 46. The lock will thus be operable in a normal fashion suitable for hotel installations, in that the bolt can be retracted by manual rotation of the inside knob 10 or by key actuation of the core in the outside knob 12.

When it is desired to disable the lock from key actuation of the core in the outside knob 12, and thus to lock out service personnel, the push button 36 in the inside knob is thrust inward sufficiently to allow the catch member 100 to engage in the notches 39 and latch the thrust rod 38 in its inward position. The inward movement of the thrust rod forces the cup 98 to the left from its FIG. 2 position and this thrusts against the blade 90 to move the throw plug assembly 84 to its disabling or disengaged position as shown in FIG. 3. The narrow section 96 of the blade 90 will then lie in the cross slot 92 and can be rotated therein without transmitting motion to the roll-back sleeve 68. Accordingly, any key rotation of the key plug of the core 14 will merely rotate the throw plug assembly but will not rotate the roll-back sleeve and will not retract the bolt.

When the throw plug assembly is thus moved to the left to its disengaged or disabling position shown in FIG. 3, it will carry the indicator blade 16 to the left and cause its end to be projected through and beyond the face of the knob 12 to serve as an indication that the outside knob and its core are in locked-out position and that the hotel room occupant wishes not to be disturbed.

If it is desired to change the combination of the core 14 or if an emergency exists in which it is necessary to open the lock from the outside, a special control key 62 may be inserted in the core 14 and rotated to retract the retainer lug 60 of that core. The core 14 can then be withdrawn through the face of the knob. Desirably, it will carry with it the entire throw plug assembly, which will be tied to the core by the springs 88 in the throw pin holes of the key plug 56. With the core and the throw plug assembly removed, it is then possible to insert a tool such as a screw driver or the like into the open core chamber and into the cross-slot 92 in the roll-back sleeve 68, and to rotate that sleeve to retract the bolt. The same core 14 or a differently combinated replacement core may then be inserted in the core chamber, with the retainer lug 60 of the core retracted by means of a control key 62. When the core is in place, the retainer lug 60 is projected to its normal position as shown in FIG. 5, so as to engage behind a shoulder 66 on the knob sleeve 40. The control key is then withdrawn.

In the lock mechanism shown, key actuation of the core 14 to cause the roll-back cam 70 to move against the cam portion 33 of the retractor 32 and retract the bolt 20 requires rotation of the key plug 56 to the left or counter-clockwise as viewed from the front of the outside knob— opposite from the clockwise movement indicated in FIG. 4. To provide right-hand or clockwise rotation of the key plug 56, it is obvious and within the skill of the art to reverse the hand of the pertinent parts to provide such right-hand operation.

We claim:

1. Apparatus for providing hotel function in a cylindrical lock having inner and outer knobs supported by knob sleeves on a lock chassis, and having a locking bolt, a key-removable lock core in the outer knob, and a key-actuated bolt roll-back cam for operation by the key plug of such core to retract the bolt, comprising a throw member for connecting the key plug of the core to the key-actuated roll-back cam, said member being axially movable between operative and disabling positions, said member having means effective in its operative position to connect the key plug to the key-actuated roll-back cam for actuating such cam to retract the bolt in response to key operation of the core, said member in its disabling position being effective to disconnect the key plug from such roll-back cam and thereby disable the lock core from actuating the cam to retract the bolt, means for moving said throw member from its operative position to its disabling position, and means for actuating such means from adjacent the inside knob, a slideway formed in the outer knob contiguous to the core, an indicator movably mounted in the slideway alongside said core, and means connecting said indicator to said throw member for axial movement therewith so as to be moved to an indicating position when said throw member is moved to its disabling position.

2. Apparatus as in claim 1 wherein the key plug of the core has a pair of spaced axial holes in its rear end, further comprising a throw assembly including a central body, a pair of throw pins on said body and slidably received in said holes, said throw member being connected to said body and comprising a flat blade having a wide section and an axially spaced reduced section, said roll-back cam being carried on a roll-back sleeve having a rear end wall containing a diametric slot, said flat blade extending through said slot and having its full width section in said slot when the flat blade throw member is in operative position so as to clutch the throw member to the roll-back sleeve, said flat blade having its reduced section in said slot when the throw member is in its disabling position, such reduced section being rotatable in the slot so as to declutch the throw member from the roll-back sleeve, a collar rotatably mounted to said central body of the throw assembly, and an indicator blade extending from said collar alongside the core and through the face of the outside knob, the operative position of the throw assembly being inward of the disabling position, and the indicator blade being of a length to be projected from the face of the knob when the throw assembly is moved from operative to disabling position.

3. Apparatus as in claim 2 in which said throw assembly is removable by axial movement through the core-receiving opening in the outer knob.

4. A cylinder lock, comprising a knob having an opening in its face for the reception of a key-removable core which includes a rotatable key plug, a lock bolt and rotatable means for retracting the bolt, axially movable throw means having an operative position in which it connects the key plug to rotate said bolt retracting means and having an axially displaced disabling position in which it disables the key plug from rotating said bolt-retracting means, means to move the throw means between said two positions, a slideway formed in the knob contiguous to and in open communication with said core-receiving opening, and an indicator blade mounted in said slideway and extending from the face of the knob rearward alongside the position of the key-removable core, said blade being connected to said throw means so as to permit relative rotation thereof and connected for axial movement with said throw means so as to indicate at the face of the knob the axial position of the throw means.

5. A cylinder lock, comprising means forming a core chamber for a key-removable lock core having a body lobe containing a rotatable key plug and having a side lobe containing tumbler pins, a core receivable in said chamber and having a core retainer for retaining the core in the chamber and retractable with a suitable key to permit axial retraction and replacement of the core, a slideway contiguous to the side of the core chamber and open thereto, a throw assembly mounted in said knob behind said core and having a throw element connected for rotation by the key plug of said core and for axial movement relative thereto, an indicator bar disposed in said slideway and extending alongside said core, and means connecting said indicator bar to said throw element for axial movement therewith but so as to permit relative rotation thereof.

6. A cylinder lock as in claim 5 in which said throw assembly has an axially projected area within the area of the core chamber and slideway and is insertable and removable therethrough.

7. A cylinder lock as in claim 6 with the addition of releasable means connecting the throw assembly to the core for removal therewith from the knob.

8. A cylinder lock, comprising means forming a core chamber for a key-removable lock core, a lock core mounted in said chamber, and having a rotatable key plug provided with axial holes in the rear of the key plug, a throw assembly having a pair of throw pins slidable in said holes and supported thereby for axial movement between alternative functional positions, a slideway contiguous to the side of the core chamber and open thereto, an indicator bar slidable in said slideway and having a collar thereon rotatably engaged with said throw assembly and connecting the bar for axial movement with said throw assembly between retracted and projected positions for indicating the respective functional positions of the throw assembly, and means for moving the throw assembly between its alternative positions.

9. A cylinder lock as in claim 8 with the addition of a spring in one of said axial holes biasing the throw pin therein outwardly so as to bias the throw assembly to one of its alternative positions, said spring being connected to said throw pin and frictionally engaged with the key plug so as to connect the throw assembly to the core for removal therewith.

* * * * *